US008243935B2

(12) United States Patent
Mizuno

(10) Patent No.: US 8,243,935 B2
(45) Date of Patent: Aug. 14, 2012

(54) SOUND IMAGE LOCALIZATION CONTROL APPARATUS

(75) Inventor: Ko Mizuno, Kyoto (JP)

(73) Assignee: Panasonic Corporation, Osaka (JP)

( * ) Notice: Subject to any disclaimer, the term of this patent is extended or adjusted under 35 U.S.C. 154(b) by 1206 days.

(21) Appl. No.: 11/916,799

(22) PCT Filed: Jun. 22, 2006

(86) PCT No.: PCT/JP2006/312507

§ 371 (c)(1),
(2), (4) Date: Dec. 6, 2007

(87) PCT Pub. No.: WO2007/004433

PCT Pub. Date: Jan. 11, 2007

(65) Prior Publication Data

US 2009/0034745 A1 Feb. 5, 2009

(30) Foreign Application Priority Data

Jun. 30, 2005 (JP) ..... 2005-192517

(51) Int. Cl.
*H04R 5/00* (2006.01)

(52) U.S. Cl. ..... 381/18; 381/17

(58) Field of Classification Search ..... 381/17, 381/18

See application file for complete search history.

(56) References Cited

U.S. PATENT DOCUMENTS

| | | | | |
|---|---|---|---|---|
| 5,404,406 | A * | 4/1995 | Fuchigami et al. | 381/17 |
| 5,742,688 | A * | 4/1998 | Ogawa et al. | 381/17 |
| 5,889,867 | A | 3/1999 | Bauck | |
| 7,167,566 | B1 | 1/2007 | Bauck | |

FOREIGN PATENT DOCUMENTS

| | | |
|---|---|---|
| JP | 6-165298 | 6/1994 |
| JP | 6-225397 | 8/1994 |
| JP | 9-171387 | 6/1997 |
| JP | 2000-165984 | 6/2000 |
| JP | 2004-23674 | 1/2004 |

OTHER PUBLICATIONS

International Search Report issued Jul. 18, 2006 in the International (PCT) Application of which the present application is the U.S. National Stage.

Extended European Search Report issued Feb. 3, 2009 in the corresponding European application.

Bauck et al., "Generalized Transaural Stereo and Applications," Journal of the Audio Engineering Society, Audio Engineering Society, New York, vol. 44, No. 9, Sep. 1, 1996.

* cited by examiner

*Primary Examiner* — Leonard Chang

(74) *Attorney, Agent, or Firm* — Wenderoth, Lind & Ponack, L.L.P.

(57) ABSTRACT

Provided is a sound image localization control apparatus allowing, when sound is reproduced so as to perform sound image localization for a plurality of users, each of the plurality of users to variably adjust an acoustical effect individually without diminishing a sound image localization effect. The sound image localization control apparatus includes a processing characteristic setting means (13; 14) setting a processing characteristic in a controlling means (12), such that each of acoustic transfer functions, for at least two predetermined positions, represents a desired characteristic. Further, the controlling means (12) of sound image localization control apparatus receives an acoustic signal and the processing characteristic which is set by the processing characteristic setting means and performs signal processing. Additionally, the sound image localization control apparatus includes a sound reproducing means (3) receiving an output from the controlling means.

11 Claims, 12 Drawing Sheets

SOUND IMAGE LOCALIZATION CONTROL APPARATUS

TECHNICAL FIELD

The present invention relates to a sound image localization control apparatus.

BACKGROUND ART

In recent years, contents such as a movie and music recorded on a DVD or the like have become widely used, and therefore a reproducing apparatus capable of providing an ideal sense of localization and an ideal sense of a sound field while reproducing multi-channel audio in a living room or in a vehicle has been proposed. However, reproducing characteristics of such an apparatus are designed for one user and accordingly an ideal acoustical effect is not exerted on other users excluded from consideration. Thus, an apparatus to solve such a problem is proposed in patent document 1. Hereinafter, a sound reproducing apparatus disclosed in patent document 1 will be described with reference to drawings.

FIG. 9 shows a sound reproducing apparatus 1, which is disclosed in patent document 1, provided in a front seat of a vehicle. To be more specific, by making two passengers L1 and L2 in the vehicle as listeners hear signal B1, which is reproduced by a recording device, by their respective left ears and hear signal B2, which is reproduced by the recording device, by their respective right ears, a similar acoustical effect of contents stored in a recording device 2 is exerted on each of the passengers. In front of passengers L1 and L2, four speakers 3*a*, 3*b*, 3*c*, and 3*d* are provided and are connected to amplifiers 4*a*, 4*b*, 4*c*, and 4*d*, respectively. Each speaker is paired with a corresponding amplifier so as to form acoustic generation means. Meanwhile, acoustic information recorded by using a well-known binaural recording system is stored in the recording device 2. The recording device 2 is connected to each of the amplifiers 4*a*, 4*b*, 4*c*, and 4*d* via an inverse filter network 5 structured in a procedure described below.

When the inverse filter network is structured, an acoustic transfer function hij (i=1 to 4: a symbol representing an ear, j=1 to 4: a symbol representing a speaker) between each of the speakers 3*a*, 3*b*, 3*c*, and 3*d* and both ears of the passengers is calculated in advance. Here, only h11 to h41 are shown. With reference to FIG. 10, a method for calculating the acoustic transfer function hij is described. A test signal generator 6 connected to each of the amplifiers 4*a*, 4*b*, 4*c*, and 4*d* generates a wideband signal such as a white noise and calculates the acoustic transfer function hij by using sounds S1, S2, S3, and S4 generated from the speakers 3*a*, 3*b*, 3*c*, and 3*d*, respectively; and sounds M1, M2, M3, and M4 measured by both ears of dummy heads D1 and D2 which are placed in assumed positions of passengers. In practice, the amplifiers are each activated sequentially. In other words, when speaker 3*a*, for example, is activated, the other speakers 3*b*, 3*c*, and 3*d* are not activated. The generated sounds S1 to S4, the measured sounds M1 to M4, and the acoustic transfer function hij satisfy a relation represented by the following equation.

$$\begin{bmatrix} M_1 \\ M_2 \\ M_3 \\ M_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix} \begin{bmatrix} S_1 \\ S_2 \\ S_3 \\ S_4 \end{bmatrix} \quad \text{[equation 1]}$$

An effect to be exerted by the sound reproducing apparatus 1 shown in FIG. 9 is represented as follows.

$$\begin{bmatrix} M_1 \\ M_2 \\ M_3 \\ M_4 \end{bmatrix} = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \begin{bmatrix} B_1 \\ B_2 \\ B_1 \\ B_2 \end{bmatrix} \quad \text{[equation 2]}$$

Equation 2 is transformed as follows.

$$\begin{bmatrix} M_1 \\ M_2 \\ M_3 \\ M_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix} \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} \begin{bmatrix} B_1 \\ B_2 \\ B_1 \\ B_2 \end{bmatrix} \quad \text{[equation 3]}$$

Equation 1 is assigned to equation 3 as follows.

$$\begin{bmatrix} S_1 \\ S_2 \\ S_3 \\ S_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} \begin{bmatrix} B_1 \\ B_2 \\ B_1 \\ B_2 \end{bmatrix} \quad \text{[equation 4]}$$

$$\begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} = \frac{1}{|H|} \begin{bmatrix} H_{11} & H_{21} & H_{31} & H_{41} \\ H_{12} & H_{22} & H_{32} & H_{42} \\ H_{13} & H_{23} & H_{33} & H_{43} \\ H_{14} & H_{24} & H_{34} & H_{44} \end{bmatrix} \quad \text{[equation 5]}$$

Accordingly, when the inverse filter network 5 as shown in FIG. 9 is designed so as to satisfy equation 4 and is provided before the amplifiers 4*a*, 4*b*, 4*c*, and 4*d*, and a signal for a left ear and a signal for a right ear are inputted to the inverse filter network, as a substitute for an output from the test signal generator 6, the signal for the left ear and the signal for the right ear become a signal for a left ear and a signal for a right ear of each dummy head D1 and D2. The signal for the left ear and the signal for the right ear are inputted to a left-hand input section and a right-hand input section, respectively, of the inverse filter network 5 shown in FIG. 9. Elements which configure the inverse filter network 5 are each represented by the following equations.

$$|H| = h_{11}\begin{vmatrix} h_{22} & h_{23} & h_{24} \\ h_{32} & h_{33} & h_{34} \\ h_{42} & h_{43} & h_{44} \end{vmatrix} - h_{12}\begin{vmatrix} h_{21} & h_{23} & h_{24} \\ h_{31} & h_{33} & h_{34} \\ h_{41} & h_{43} & h_{44} \end{vmatrix} + h_{13}\begin{vmatrix} h_{21} & h_{22} & h_{24} \\ h_{31} & h_{32} & h_{34} \\ h_{41} & h_{42} & h_{44} \end{vmatrix} - h_{14}\begin{vmatrix} h_{21} & h_{22} & h_{23} \\ h_{31} & h_{32} & h_{33} \\ h_{41} & h_{42} & h_{43} \end{vmatrix} \quad \text{[equation 6]}$$

$$H_{11} = +\left\{h_{22}\begin{vmatrix} h_{33} & h_{34} \\ h_{43} & h_{44} \end{vmatrix} - h_{23}\begin{vmatrix} h_{32} & h_{34} \\ h_{42} & h_{44} \end{vmatrix} + h_{24}\begin{vmatrix} h_{32} & h_{33} \\ h_{42} & h_{43} \end{vmatrix}\right\} \quad \text{[equation 7]}$$

$$H_{12} = -\left\{h_{21}\begin{vmatrix} h_{33} & h_{34} \\ h_{43} & h_{44} \end{vmatrix} - h_{23}\begin{vmatrix} h_{31} & h_{34} \\ h_{41} & h_{44} \end{vmatrix} + h_{24}\begin{vmatrix} h_{31} & h_{33} \\ h_{42} & h_{43} \end{vmatrix}\right\} \quad \text{[equation 8]}$$

$$H_{13} = +\left\{h_{21}\begin{vmatrix} h_{32} & h_{34} \\ h_{42} & h_{44} \end{vmatrix} - h_{22}\begin{vmatrix} h_{31} & h_{34} \\ h_{41} & h_{44} \end{vmatrix} + h_{24}\begin{vmatrix} h_{31} & h_{32} \\ h_{41} & h_{42} \end{vmatrix}\right\} \quad \text{[equation 9]}$$

$$H_{14} = -\left\{h_{21}\begin{vmatrix} h_{32} & h_{33} \\ h_{42} & h_{43} \end{vmatrix} - h_{22}\begin{vmatrix} h_{31} & h_{33} \\ h_{41} & h_{43} \end{vmatrix} + h_{23}\begin{vmatrix} h_{31} & h_{32} \\ h_{41} & h_{42} \end{vmatrix}\right\} \quad \text{[equation 10]}$$

$$H_{21} = -\left\{h_{12}\begin{vmatrix} h_{33} & h_{34} \\ h_{43} & h_{44} \end{vmatrix} - h_{13}\begin{vmatrix} h_{32} & h_{34} \\ h_{42} & h_{44} \end{vmatrix} + h_{14}\begin{vmatrix} h_{32} & h_{33} \\ h_{42} & h_{43} \end{vmatrix}\right\} \quad \text{[equation 11]}$$

-continued $$H_{22} = +\left\{h_{11}\begin{vmatrix} h_{33} & h_{34} \\ h_{42} & h_{44} \end{vmatrix} - h_{13}\begin{vmatrix} h_{31} & h_{34} \\ h_{41} & h_{44} \end{vmatrix} + h_{14}\begin{vmatrix} h_{31} & h_{33} \\ h_{41} & h_{43} \end{vmatrix}\right\} \quad \text{[equation 12]}$$

$$H_{23} = -\left\{h_{11}\begin{vmatrix} h_{32} & h_{34} \\ h_{42} & h_{44} \end{vmatrix} - h_{12}\begin{vmatrix} h_{31} & h_{34} \\ h_{41} & h_{44} \end{vmatrix} + h_{14}\begin{vmatrix} h_{31} & h_{32} \\ h_{41} & h_{42} \end{vmatrix}\right\} \quad \text{[equation 13]}$$

$$H_{24} = +\left\{h_{11}\begin{vmatrix} h_{32} & h_{33} \\ h_{42} & h_{43} \end{vmatrix} - h_{12}\begin{vmatrix} h_{31} & h_{33} \\ h_{41} & h_{43} \end{vmatrix} + h_{13}\begin{vmatrix} h_{31} & h_{32} \\ h_{41} & h_{42} \end{vmatrix}\right\} \quad \text{[equation 14]}$$

$$H_{31} = +\left\{h_{12}\begin{vmatrix} h_{23} & h_{24} \\ h_{43} & h_{44} \end{vmatrix} - h_{13}\begin{vmatrix} h_{22} & h_{24} \\ h_{42} & h_{44} \end{vmatrix} + h_{14}\begin{vmatrix} h_{22} & h_{23} \\ h_{42} & h_{43} \end{vmatrix}\right\} \quad \text{[equation 15]}$$

$$H_{32} = -\left\{h_{11}\begin{vmatrix} h_{23} & h_{24} \\ h_{43} & h_{44} \end{vmatrix} - h_{13}\begin{vmatrix} h_{21} & h_{24} \\ h_{41} & h_{44} \end{vmatrix} + h_{14}\begin{vmatrix} h_{21} & h_{23} \\ h_{41} & h_{43} \end{vmatrix}\right\} \quad \text{[equation 16]}$$

$$H_{33} = +\left\{h_{11}\begin{vmatrix} h_{22} & h_{24} \\ h_{42} & h_{44} \end{vmatrix} - h_{12}\begin{vmatrix} h_{21} & h_{24} \\ h_{41} & h_{44} \end{vmatrix} + h_{14}\begin{vmatrix} h_{21} & h_{22} \\ h_{41} & h_{42} \end{vmatrix}\right\} \quad \text{[equation 17]}$$

$$H_{34} = -\left\{h_{11}\begin{vmatrix} h_{22} & h_{23} \\ h_{42} & h_{43} \end{vmatrix} - h_{12}\begin{vmatrix} h_{21} & h_{23} \\ h_{41} & h_{43} \end{vmatrix} + h_{13}\begin{vmatrix} h_{21} & h_{22} \\ h_{41} & h_{42} \end{vmatrix}\right\} \quad \text{[equation 18]}$$

$$H_{41} = -\left\{h_{12}\begin{vmatrix} h_{23} & h_{24} \\ h_{33} & h_{34} \end{vmatrix} - h_{13}\begin{vmatrix} h_{22} & h_{24} \\ h_{32} & h_{34} \end{vmatrix} + h_{14}\begin{vmatrix} h_{22} & h_{23} \\ h_{32} & h_{33} \end{vmatrix}\right\} \quad \text{[equation 19]}$$

$$H_{42} = +\left\{h_{11}\begin{vmatrix} h_{23} & h_{24} \\ h_{33} & h_{34} \end{vmatrix} - h_{13}\begin{vmatrix} h_{21} & h_{24} \\ h_{31} & h_{34} \end{vmatrix} + h_{14}\begin{vmatrix} h_{21} & h_{23} \\ h_{31} & h_{33} \end{vmatrix}\right\} \quad \text{[equation 20]}$$

$$H_{43} = -\left\{h_{11}\begin{vmatrix} h_{22} & h_{24} \\ h_{32} & h_{34} \end{vmatrix} - h_{12}\begin{vmatrix} h_{21} & h_{24} \\ h_{31} & h_{34} \end{vmatrix} + h_{14}\begin{vmatrix} h_{21} & h_{22} \\ h_{41} & h_{32} \end{vmatrix}\right\} \quad \text{[equation 21]}$$

$$H_{44} = +\left\{h_{11}\begin{vmatrix} h_{22} & h_{23} \\ h_{32} & h_{33} \end{vmatrix} - h_{12}\begin{vmatrix} h_{21} & h_{23} \\ h_{31} & h_{33} \end{vmatrix} + h_{13}\begin{vmatrix} h_{21} & h_{22} \\ h_{31} & h_{32} \end{vmatrix}\right\} \quad \text{[equation 22]}$$

When signal B1 and signal B2, both of which are binaural-recorded, are processed by the inverse filter network 5 having the configuration as described above, sounds at both ears of passenger L1 are B1 and B2, and sounds at both ears of passenger L2 are B1 and B2. Therefore, the original sound field where recording has been performed is experienced by passengers L1 and L2.

If the configuration disclosed in patent document 1 includes controlling means for processing an output from the recording device 2 so as to input the output to the inverse filter network 5 by using digital filters or the like simulating predetermined acoustic transfer functions, it becomes possible to position a sound image in a predetermined direction. FIG. 11 is a diagram showing an acoustic transfer function G1 between a virtual sound source 7 and the dummy head D1, and an acoustic transfer function G2 between a virtual sound source 7 and the dummy head D1. FIG. 12 is a diagram showing a sound reproducing apparatus for positioning a sound image in a predetermined direction. Identical components to those in FIG. 9 bear the identical reference characters. The predetermined acoustic transfer functions Gland G2 are set as coefficients in filters 8*a* and 8*b*, respectively. A monophonic sound source 9, in which not a binaural-recorded sound but a monophonic signal B0 is recorded, is used as a sound source. In the configuration shown in FIG. 12, a sound at a left ear position of each of passengers L1 and L2 is G1•B0 and a sound at a right ear position of each of passengers L1 and L2 is G2•B0. Therefore, each sound is listened as if the sound is coming from the direction of the virtual sound source shown in FIG. 7. As a matter of course, the monophonic signal B0 may be processed in advance by using the acoustic transfer functions G1 and G2, or the acoustic transfer functions G1 and G2 may be incorporated into the elements configuring the inverse filter network, in order to produce the same effect.

[Patent Document 1] Japanese Laid-Open Patent Publication No. 6-165298

DISCLOSURE OF THE INVENTION

Problems to be Solved by the Invention

However, in the sound reproducing apparatuses shown in FIG. 9 and FIG. 10, it is difficult to variably adjust the acoustical effect such as a frequency characteristic and a sound volume, for each user, individually if once the reproducing characteristics of the inverse filter network 5 are designed. In other words, each time the acoustical effect for each user is changed, the sound reproducing apparatus disclosed in patent document 1 requires designing of control filters, resulting in increasing the amount of computing and difficulty in realization.

Therefore, in view of aforementioned problems, an object of the present invention is to provide a sound image localization control apparatus which allows a plurality of users to variably adjust the acoustical effect individually without diminishing a sound image localization effect of a sound reproducing apparatus which performs sound image localization for the plurality of users.

Solution to the Problems

The object of the present invention is achieved by a sound image localization control apparatus having a configuration described below. The sound image localization control apparatus comprises: processing characteristic setting means for setting a processing characteristic such that acoustic transfer functions for at least two predetermined positions each represent a desired characteristic; controlling means for receiving an acoustic signal and the processing characteristic which is set by the processing characteristic setting means, and performing signal processing; and sound reproducing means for receiving an output from the controlling means.

The object of the present invention is achieved by a sound image localization control method described below. The sound image localization control method is for a sound image localization control system capable of producing a common sound image localization effect at a plurality of predetermined positions by processing in a plurality of digital filters an acoustic signal outputted from a sound source so as to output the acoustic signal from a plurality of speakers, comprising: a first multiplication step of multiplying a value based on a sound volume control signal and/or a sound quality control signal for a first predetermined position by a first reference coefficient for the first predetermined position, the first reference coefficient being stored in a storage area; a second multiplication step of multiplying a value based on a sound volume control signal and/or a sound quality control signal for a second predetermined position by a second reference coefficient for the second predetermined position, the second reference coefficient being stored in the storage area; an addition step of adding a multiplication result of the first multiplication step to a multiplication result of the second multiplication step; and a filter coefficient setting step of setting an addition result of the addition step as a filter coefficient for each of the plurality of digital filters.

The object of the present invention is achieved by a sound image localization control program described below. The sound image localization control program is for a sound image localization control system capable of producing a common sound image localization effect at a plurality of predetermined positions by processing in a plurality of digital filters an acoustic signal outputted from a sound source so as to output the acoustic signal from a plurality of speakers, the sound image localization control program causing a computer to execute: a first multiplication step of multiplying a value based on a sound volume control signal and/or a sound quality control signal for a first predetermined position by a first reference coefficient for the first predetermined position, the first reference coefficient being stored in a storage area; a second multiplication step of multiplying a value based on a sound volume control signal and/or a sound quality control signal for a second predetermined position by a second reference coefficient for the second predetermined position, the second reference coefficient being stored in the storage area; an addition step of adding a multiplication result of the first multiplication step to a multiplication result of the second multiplication step; and a filter coefficient setting step of setting an addition result of the addition step as a filter coefficient for each of the plurality of digital filters.

The object of the present invention is achieved by an integrated circuit having a configuration described below. The integrated circuit is used for a sound image localization control apparatus and is capable of reading from a memory storing at least two processing characteristic coefficients corresponding to at least two predetermined positions, respectively, the at least two processing characteristic coefficients, the integrated circuit comprising: a processing characteristic setting section for setting a processing characteristic by using the at least two processing characteristic coefficients stored in the memory such that acoustic transfer functions for the at least two predetermined positions each represent a desired characteristic; and a controlling section for receiving an acoustic signal and the processing characteristic which is set by the processing characteristic setting section and performing signal processing to generate an output signal to a sound reproducing section.

EFFECT OF THE INVENTION

As described above, according to the present invention, provided is a sound image localization control apparatus which allows a plurality of users to variably adjust the acoustical effect individually without diminishing the sound image localization effect of a sound reproducing apparatus which performs sound image localization for the plurality of users.

DESCRIPTION OF THE REFERENCE CHARACTERS

Figure 1:
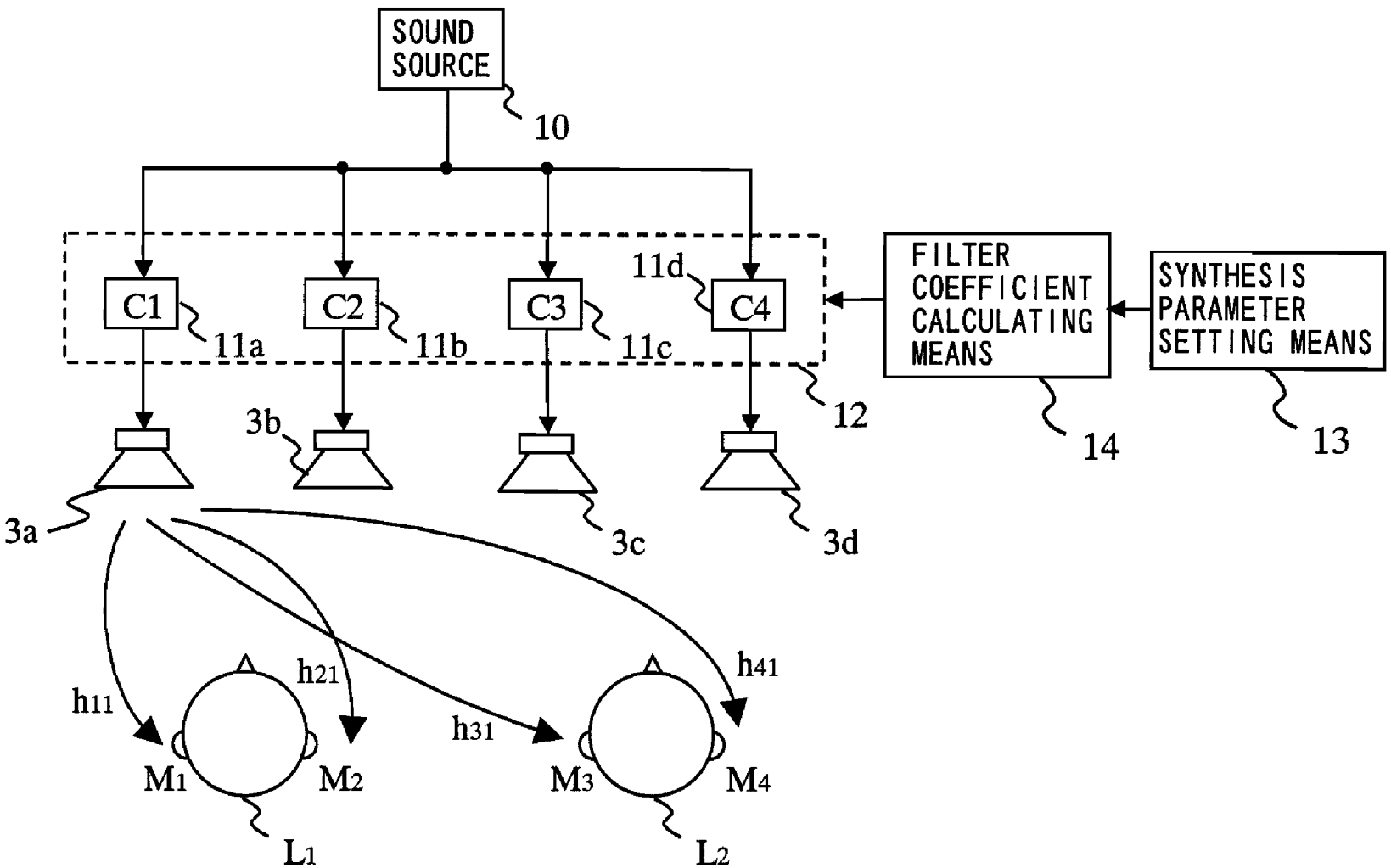
FIG. 1 is a schematic view showing a configuration of a sound image localization control apparatus according to a first embodiment.

1 sound reproducing apparatus
2 recording device
3*a*, 3*b*, 3*c*, 3*d*, 3*e*, 3*f*, 3*g*, 3*h* speaker
4*a*, 4*b*, 4*c*, 4*d* amplifier
5 inverse filter network
6 test signal generator
7 virtual sound source
8*a*, 8*b* filter
9 monophonic sound source
10 sound source
11*a*, 11*b*, 11*c*, 11*d*, 11*e*, 11*f*, 11*g*, 11*h* control digital filter
12 control processing section
13 synthesis parameter setting means
14 filter coefficient calculating means
15*a*, 15*b*, 15*c*, 15*d* adder
16*a*, 16*b*, 16*c*, 16*d*, 16*e*, 16*f*, 16*g*, 16*h* gain unit
50, 51, 52, 53 sound volume adjusting dial
60, 61, 62, 63 sound image localization control button
70 remote controller

BEST MODE FOR CARRYING OUT THE INVENTION (First Embodiment)

FIG. 1 is a schematic view showing a configuration of a sound image localization control apparatus according to a first embodiment. The sound image localization control apparatus according to the present embodiment allows two users to simultaneously share a common sound image localization effect and to individually adjust sound volumes. The sound image localization control apparatus mainly comprises a sound source 10, speakers 3*a*, 3*b*, 3*c*, and 3*d*, a control processing section 12, synthesis parameter setting means 13, and filter coefficient calculating means 14. The synthesis parameter setting means 13 and the filter coefficient calculating means 14 according to the present embodiment correspond to processing characteristic setting means. The control processing section 12 corresponds to controlling means, and the speakers 3*a*, 3*b*, 3*c*, and 3*d* correspond to sound reproducing means.

The sound source 10 may be a monophonic sound source, one channel signal source among multi-channel sound sources, or a sound source synthesized from a plurality of sound sources among the multi-channel sound sources. In the present embodiment, a case where a monophonic sound source is used as the sound source 10 will be described for ease of description.

Figure 9:
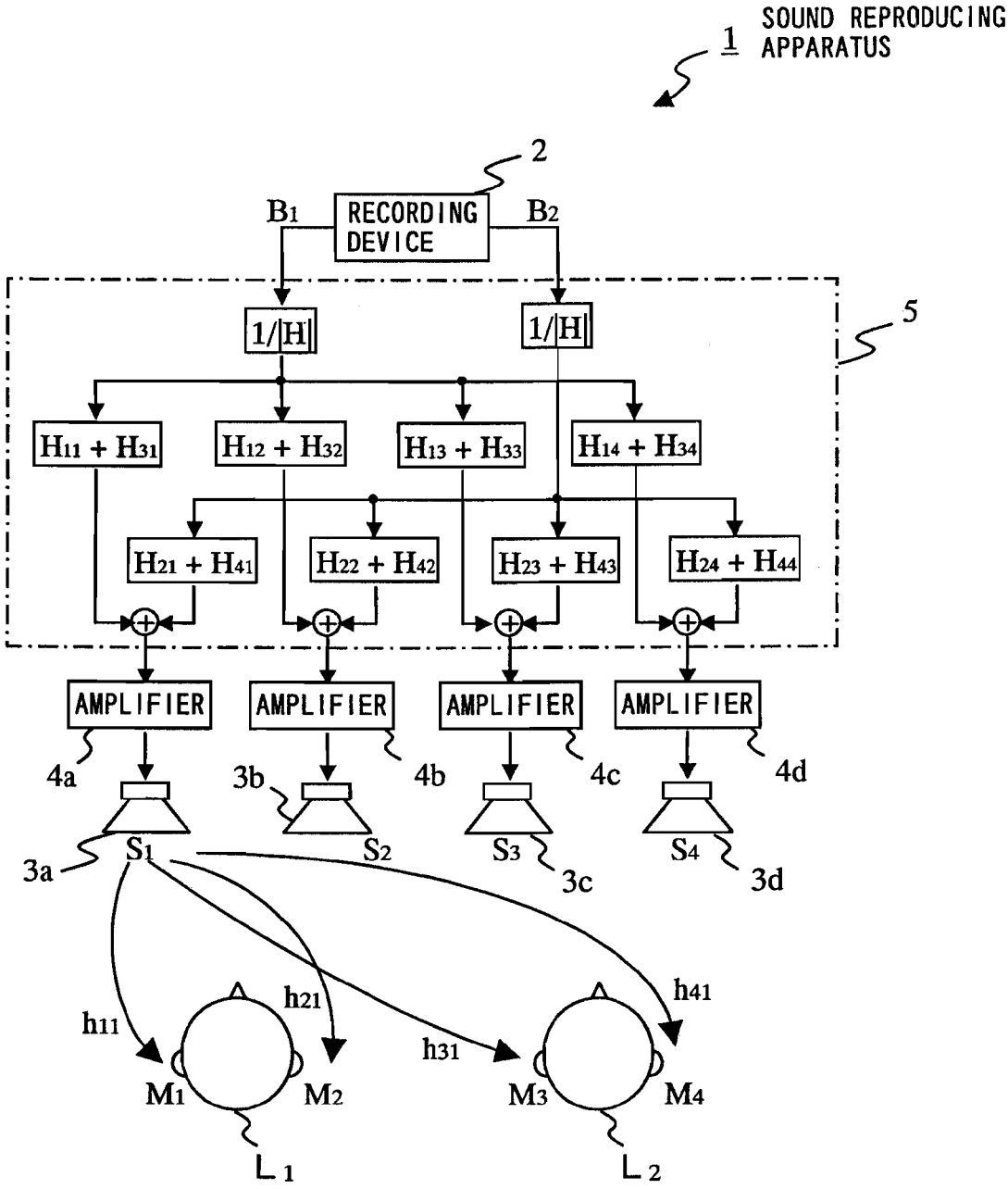
FIG. 9 PRIOR ART
FIG. 9 is a schematic view showing a configuration of a conventional sound reproducing apparatus.
Figure 10:
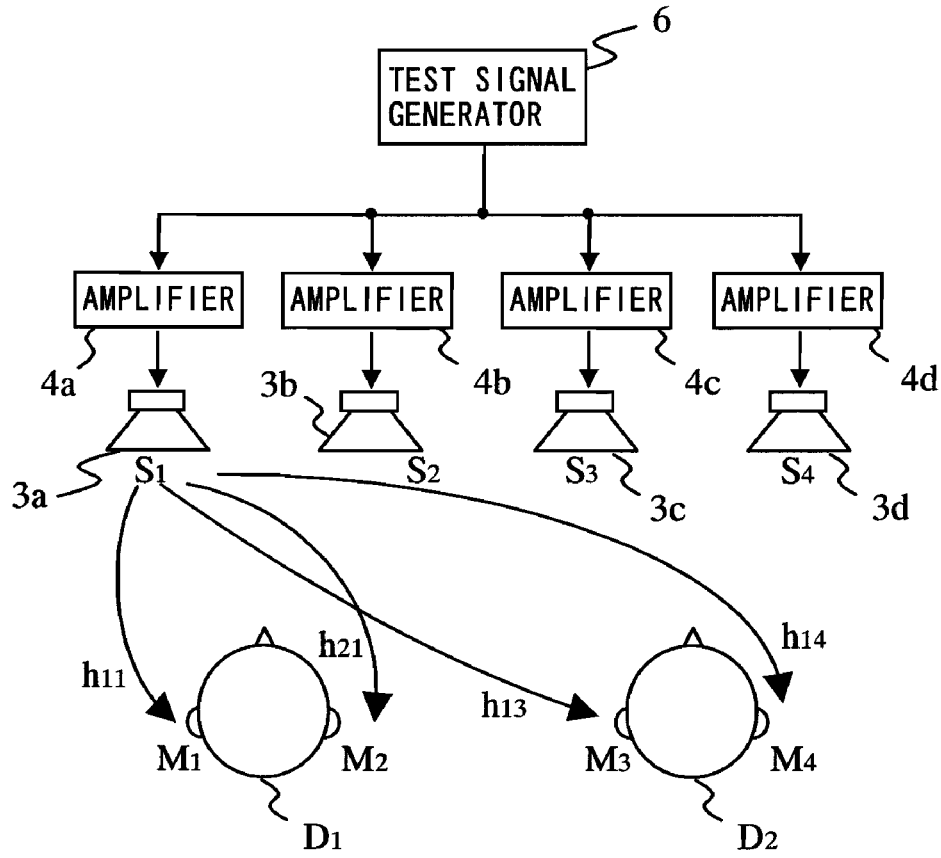
FIG. 10 is a diagram showing a method for calculating a transfer function.
Figure 11:
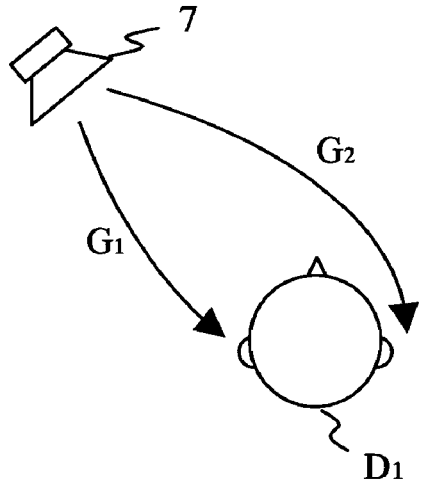
FIG. 11 is a diagram showing target transfer functions.
Figure 12:
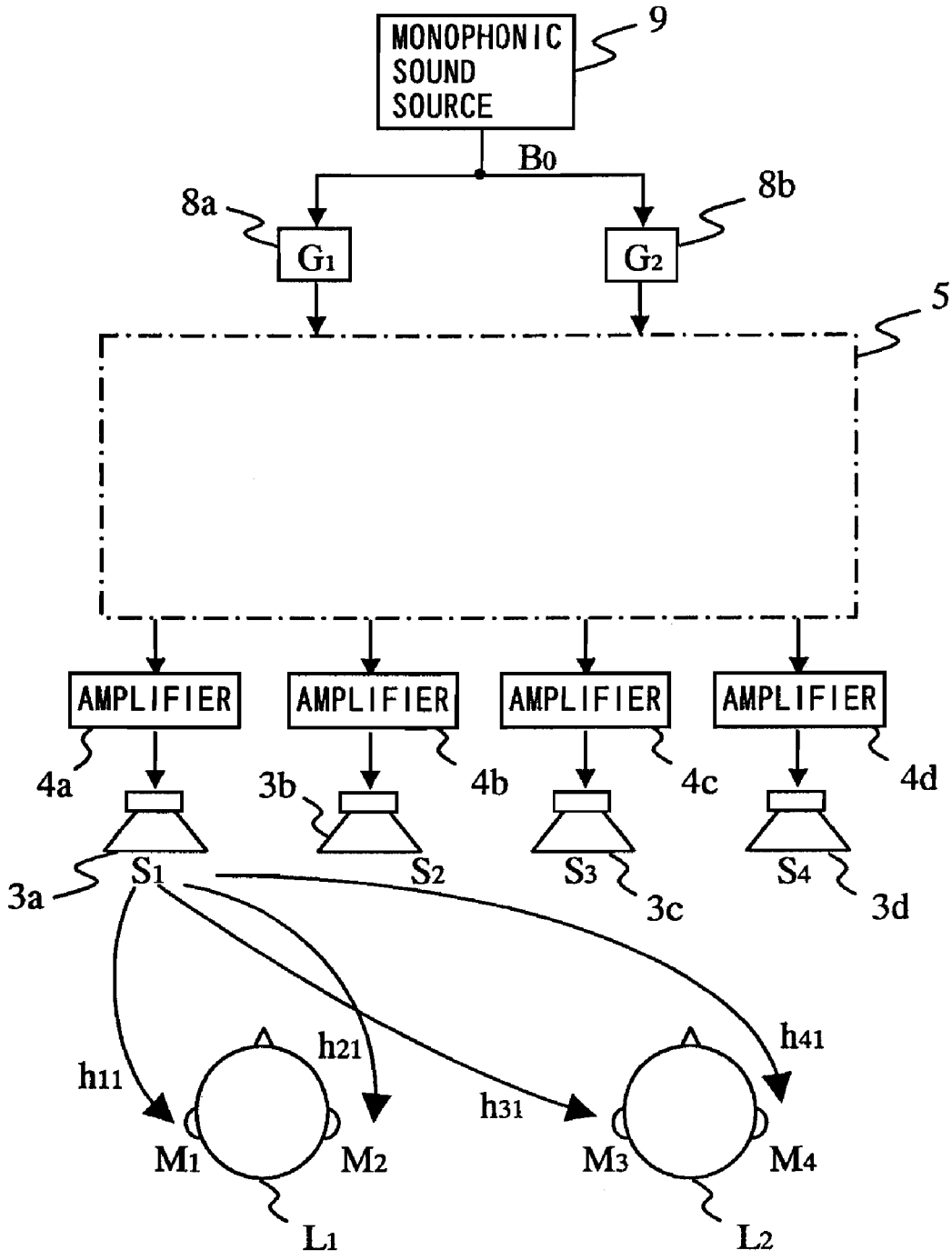
F I G. 1 2 PRIOR ART
FIG. 12 is a schematic view showing a configuration of a conventional sound reproducing apparatus which performs sound image localization control.

The control processing section 12 includes control digital filters 11*a*, 11*b*, 11*c*, and 11*d*. An output signal from the sound source 10 is inputted to each of the control digital filters 11*a*, 11*b*, 11*c*, and 11*d*. The synthesis parameter setting means 13 is an interface for each user to adjust the sound volume. The filter coefficient calculating means 14 calculates a filter coefficient for each of the control digital filters 11*a*, 11*b*, 11*c*, and 11*d* in accordance with an output signal from the synthesis parameter setting means 13 so as to input the filter coefficient to the control processing section 12. Here, passengers L1 and L2, acoustic transfer functions h11, h21, h31, and h41, and measured sounds M1, M2, M3, and M4 are identical to those shown in FIG. 9 and thus detailed descriptions thereof will be omitted. Next, a method for designing the control digital filters 11*a*, 11*b*, 11*c*, and 11*d* for producing the sound image localization effect will be described. When the position of the virtual sound source 7 shown in FIG. 11 is a targeted position for sound image localization control and transfer functions of the control digital filters 11*a*, 11*b*, 11*c*, and 11*d* are C1, C2, C3, and C4, respectively, user L1 hears, by both ears, M1 and M2 satisfying the following equation and user L2 hears, by both ears, M3 and M4 satisfying the following equation.

$$\begin{bmatrix} M_1 \\ M_2 \\ M_3 \\ M_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix} \begin{bmatrix} C_1 \\ C_2 \\ C_3 \\ C_4 \end{bmatrix} \quad \text{[equation 23]}$$

Equation 23 is transformed as follows.

$$\begin{bmatrix} C_1 \\ C_2 \\ C_3 \\ C_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} \begin{bmatrix} M_1 \\ M_2 \\ M_3 \\ M_4 \end{bmatrix} \quad \text{[equation 24]}$$

Here, target transfer functions which the users should listen are G1 and G2.

$$\begin{bmatrix} C_1 \\ C_2 \\ C_3 \\ C_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} \begin{bmatrix} G_1 \\ G_2 \\ G_1 \\ G_2 \end{bmatrix} \quad \text{[equation 25]}$$

Thus, when the control digital filters 11*a*, 11*b*, 11*c*, and 11*d* are designed so as to satisfy the above equation, user L1 hears G1 and G2 by each ear, and user L2 hears G1 and G2 by each ear. Accordingly, users L1 and L2 perceive a sound image being at the position of the virtual sound source 7. In order to calculate the filter coefficients, a determinant shown as equation 25 may be solved, or, for example, a well-known adaptation algorithm may be used for calculation.

Next, operations of the synthesis parameter setting means 13, the filter coefficient calculating means 14 and the control processing section 12, which are for enabling the users to adjust the sound volume individually, will be described. An inverse matrix part of equation 24 is transformed as represented by the following equation.

$$\begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} = \begin{bmatrix} H'_{11} & H'_{12} & H'_{13} & H'_{14} \\ H'_{21} & H'_{22} & H'_{23} & H'_{24} \\ H'_{31} & H'_{32} & H'_{33} & H'_{34} \\ H'_{41} & H'_{42} & H'_{43} & H'_{44} \end{bmatrix} \quad \text{[equation 26]}$$

Further, the following equation is used so as to obtain C1 to C4.

$$C_i = \sum_{j=1}^{4} H'_{ij} M_j \quad (i = 1 \text{ to } 4) \quad \text{[equation 27]}$$

Ci (i=1 to 4) represented by equation 27 corresponds to a processing characteristic to be set in the controlling means (the control digital filters 11*a*, 11*b*, 11*c*, and 11*d*) by the processing characteristic setting means.

The filter coefficient calculating means 14 separately stores a filter coefficient satisfying a transfer function for former two members of the transfer function for each of the filters, represented by equation 27, and a filter coefficient satisfying a transfer function for latter two members of the transfer function for each of the filters, represented by equation 27.

$$C_{i1} = \sum_{j=1}^{2} H'_{ij} G_j,\ C_{i2} = \sum_{j=3}^{4} H'_{ij} G_{j-2} (i = 1 \text{ to } 4) \quad \text{[equation 28]}$$

To be more specific, the filter coefficient calculating means 14 stores as reference coefficients eight filter coefficients (C11, C12, C21, C22, C31, C32, C41, C42) satisfying transfer functions represented by equation 28, which includes the target transfer functions G1 and G2. The reference coefficients each correspond to a processing characteristic coefficient.

In the meantime, information about a sound volume at which each user desires to listen is inputted to the synthesis parameter setting means 13. Here, as an example, described is a case where user L1 desires to listen at a sound volume which is a times higher than a sound volume obtained by sound reproduction using the reference coefficients, and user L2 desires to listen at a sound volume which is β times higher than the sound volume obtained by sound reproduction using the reference coefficients. The synthesis parameter setting means 13 inputs information about the α times sound volume and the β times sound volume to the filter coefficient calculating means 14. The filter coefficient calculating means 14 calculates filter coefficients, by using the following equation, in accordance with information about the sound volumes, which is inputted from the synthesis parameter setting means 13.

$$C_i = \alpha C_{i1} + \beta C_{i2} \ (i = 1 \text{ to } 4) \quad \text{[equation 29]}$$

The filter coefficient calculating means 14 sets the filter coefficients satisfying transfer functions obtained by equation 29, in the control processing section 12. These filter coefficients are used as coefficients for the control digital filters 11*a*, 11*b*, 11*c*, and 11*d*.

In the meantime, the former two members of equation 27 are associated with M1 and M2. In other words, the former two members determine the acoustical effect on user L1. The latter two members are associated with M3 and M4 and therefore determine the acoustical effect on user L2. Thus, when the former two members are multiplied by α as represented by equation 29, the sound volume at which user L1 listens is increased by α times. Likewise, when the latter two members are multiplied by β, the sound volume at which user L2 listens is increased by β times. Here, even if α and β are optionally changed, a ratio between the coefficients by which M1 and M2 are multiplied and a ratio between the coefficients by which M3 and M4 are multiplied do not vary. In other words, since a difference between the acoustic transfer functions for both ears does not vary, the sound image localization effect is not deteriorated.

As described above, in the sound image localization control apparatus according to the present embodiment, the filter coefficients are stored separately for each user (to be more precise, for each position at which a reproduced sound is heard) in consideration of effects of the acoustic transfer functions on the users. Thus, by setting in each of the control digital filters a coefficient (processing characteristic) determined by adding values each obtained by multiplying the reference coefficient (processing characteristic coefficient) by a constant number as represented by equation 29, it becomes possible to individually set the sound volume for each user while the sound image localization control effect is being maintained with a small amount of arithmetic processing.

The sound image localization control apparatus according to the present embodiment is typically realized by using software. In this case, a program for causing a computer to execute the above-described processing of the sound image localization control is stored in a computer-readable recording medium, e.g., a hard disk, a CD-ROM, an MO, a DVD, a semiconductor memory, or the like.

Although the configuration of the sound image localization control apparatus according to the present embodiment allows the sound volume to be adjusted, the present invention is not limited thereto. The configuration may allow each user to adjust a frequency characteristic individually. In this case, each user inputs information about a desired frequency characteristic such as a low boost to the synthesis parameter setting means 13. For example, in the case where user L1 desires to listen to a sound in which a transfer function Ga is applied to a frequency characteristic obtained by sound reproduction using the reference coefficients and user L2 desires to listen to a sound in which a transfer function Gβ is applied to the frequency characteristic obtained by sound reproduction using the reference coefficients, the filter coefficient calculating means 14 determines filter coefficients by using the following equation.

$$C_i = G_\alpha C_{i1} + G_\beta C_{i2} \ (i=1 \text{ to } 4) \qquad \text{[equation 30]}$$

Figure 2:
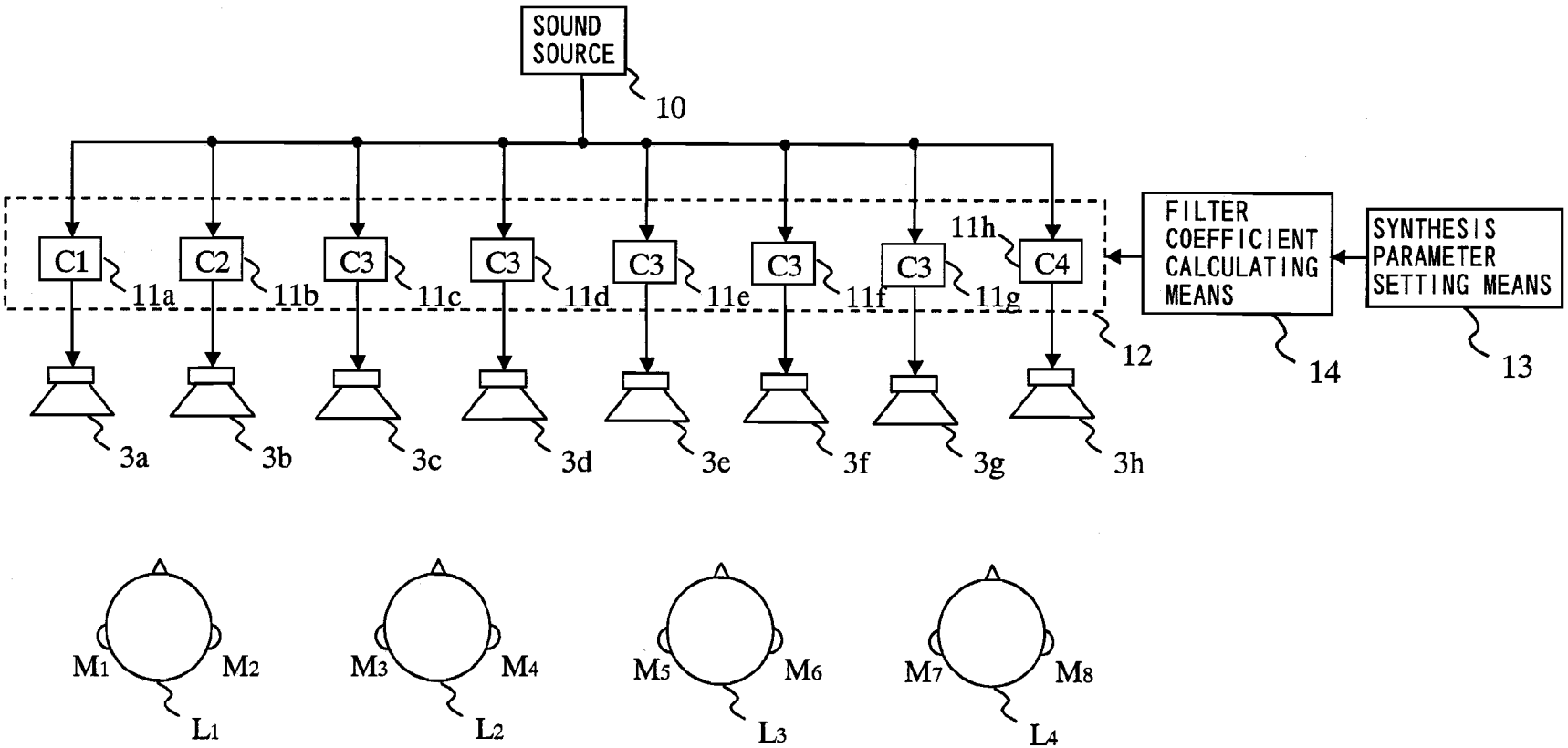
FIG. 2 is a schematic view showing a configuration of the sound image localization control apparatus which realizes both simultaneous sound image localization control and individual sound volume adjustment for four users.

Although the configuration of the sound image localization control apparatus according to the present embodiment allows two users to adjust the sound volume individually, the present invention is not limited thereto. The present invention is also applicable to a case where there are three or more users. Hereinafter, the sound image localization control apparatus for four users will be described. FIG. 2 is a schematic view showing a configuration of the sound image localization control apparatus which realizes both simultaneous sound image localization control and individual sound volume adjustment for four users L1, L2, L3 and L4. The sound image localization control apparatus shown in FIG. 2 has almost the same configuration as that shown in FIG. 1. However, there are differences as follows. To be specific, the control processing section 12 includes control digital filters 11*a*, 11*b*, 11*c*, 11*d*, 11*e*, 11*f*, 11*g*, and 11*h*. Further, M1 and M2 each represent a sound at the position of an ear of user L1, M3 and M4 each represent a sound at the position of an ear of user L2, M5 and M6 each represent a sound at the position of an ear of user L3, and M7 and M8 each represent a sound at the position of an ear of user L4.

Next, described is designing of the control digital filters 11*a*, 11*b*, 11*c*, 11*d*, 11*e*, 11*f*, 11*g*, and 11*h* for performing simultaneous sound image localization control for four users, and operations of the synthesis parameter setting means 13, the filter coefficient calculating means 14 and the control processing section 12, which are for performing individual sound volume adjustment for four users.

When an acoustic transfer function between a speaker of each control digital filter and an ear of each user is hij (i=1 to 8: a symbol indicating an ear, j=1 to 8: a symbol indicating a speaker), the following equation is obtained.

$$\begin{bmatrix} M_1 \\ M_2 \\ M_3 \\ M_4 \\ M_5 \\ M_6 \\ M_7 \\ M_8 \end{bmatrix} = \begin{bmatrix} h_{11} & h_{12} & h_{13} & h_{14} & h_{15} & h_{16} & h_{17} & h_{18} \\ h_{21} & h_{22} & h_{23} & h_{24} & h_{25} & h_{26} & h_{27} & h_{28} \\ h_{31} & h_{32} & h_{33} & h_{34} & h_{35} & h_{36} & h_{37} & h_{38} \\ h_{41} & h_{42} & h_{43} & h_{44} & h_{45} & h_{46} & h_{47} & h_{48} \\ h_{51} & h_{52} & h_{53} & h_{54} & h_{55} & h_{56} & h_{57} & h_{58} \\ h_{61} & h_{62} & h_{63} & h_{64} & h_{65} & h_{66} & h_{67} & h_{68} \\ h_{71} & h_{72} & h_{73} & h_{74} & h_{75} & h_{76} & h_{77} & h_{78} \\ h_{81} & h_{82} & h_{83} & h_{84} & h_{85} & h_{86} & h_{87} & h_{88} \end{bmatrix} \begin{bmatrix} C_1 \\ C_2 \\ C_3 \\ C_4 \\ C_5 \\ C_6 \\ C_7 \\ C_8 \end{bmatrix} \qquad \text{[equation 31]}$$

An inverse matrix of the acoustic transfer function is represented by the following equation.

$$\begin{bmatrix} h_{11} & h_{12} & h_{13} & h_{14} & h_{15} & h_{16} & h_{17} & h_{18} \\ h_{21} & h_{22} & h_{23} & h_{24} & h_{25} & h_{26} & h_{27} & h_{28} \\ h_{31} & h_{32} & h_{33} & h_{34} & h_{35} & h_{36} & h_{37} & h_{38} \\ h_{41} & h_{42} & h_{43} & h_{44} & h_{45} & h_{46} & h_{47} & h_{48} \\ h_{51} & h_{52} & h_{53} & h_{54} & h_{55} & h_{56} & h_{57} & h_{58} \\ h_{61} & h_{62} & h_{63} & h_{64} & h_{65} & h_{66} & h_{67} & h_{68} \\ h_{71} & h_{72} & h_{73} & h_{74} & h_{75} & h_{76} & h_{77} & h_{78} \\ h_{81} & h_{82} & h_{83} & h_{84} & h_{85} & h_{86} & h_{87} & h_{88} \end{bmatrix}^{-1} = \begin{bmatrix} H'_{11} & H'_{12} & H'_{13} & H'_{14} & H'_{15} & H'_{16} & H'_{17} & H'_{18} \\ H'_{21} & H'_{22} & H'_{23} & H'_{24} & H'_{25} & H'_{26} & H'_{27} & H'_{28} \\ H'_{31} & H'_{32} & H'_{33} & H'_{34} & H'_{35} & H'_{36} & H'_{37} & H'_{38} \\ H'_{41} & H'_{42} & H'_{43} & H'_{44} & H'_{45} & H'_{46} & H'_{47} & H'_{48} \\ H'_{51} & H'_{52} & H'_{53} & H'_{54} & H'_{55} & H'_{56} & H'_{57} & H'_{58} \\ H'_{61} & H'_{62} & H'_{63} & H'_{64} & H'_{65} & H'_{66} & H'_{67} & H'_{68} \\ H'_{71} & H'_{72} & H'_{73} & H'_{74} & H'_{75} & H'_{76} & H'_{77} & H'_{78} \\ H'_{81} & H'_{82} & H'_{83} & H'_{84} & H'_{85} & H'_{86} & H'_{87} & H'_{88} \end{bmatrix} \qquad \text{[equation 32]}$$

After equations 31 and 32 are solved for C1 to C8, the following equation is obtained.

$$C_i = \sum_{j=1}^{8} H'_{ij} M_j \quad (i = 1 \text{ to } 8) \qquad \text{[equation 33]}$$

The filter coefficient calculating means 14 separately stores filter coefficients satisfying transfer functions for every two members with respect to the transfer functions, which is represented by equation 33, of the filters.

$$C_{i1} = \sum_{j=1}^{2} H'_{ij} G_j,$$

$$C_{i2} = \sum_{j=3}^{4} H'_{ij} G_{j-2},$$

$$C_{i3} = \sum_{j=5}^{6} H'_{ij} G_{j-4},$$

$$C_{i4} = \sum_{j=7}^{8} H'_{ij} G_{j-6} \quad (i = 1 \text{ to } 8)$$

[equation 34]

To be more specific, the filter coefficient calculating means 14 stores as reference coefficients eight filter coefficients satisfying transfer functions represented by equation 34, which includes the target transfer functions G1 and G2. In the meantime, information about a sound volume at which each user desires to listen is inputted to the synthesis parameter setting means 13. Here, as an example, described is a case where user L1 desires to listen at a sound volume which is α times higher than a sound volume obtained by sound reproduction using the reference coefficients, user L2 desires to listen at a sound volume which is β times higher than the sound volume obtained by sound reproduction using the reference coefficients, user L3 desires to listen at a sound volume which is γ times higher than the sound volume obtained by sound reproduction using the reference coefficients, and user L4 desires to listen at a sound volume which is η times higher than the sound volume obtained by sound reproduction using the reference coefficients. The synthesis parameter setting means 13 inputs information about the α times sound volume, the β times sound volume, the γ times sound volume, and the η times sound volume to the filter coefficient calculating means 14. The filter coefficient calculating means 14 calculates filter coefficients, by using the following equation, in accordance with information about the sound volumes, which is inputted from the synthesis parameter setting means 13.

$$C_i = \alpha C_{i1} + \beta C_{i2} + \gamma C_{i3} + \eta C_{i4} \ (i = 1 \text{ to } 8)$$

[equation 35]

The filter coefficient calculating means 14 sets, as coefficients for the control digital filters 11*a*, 11*b*, 11*c*, 11*d*, 11*e*, 11*f*, 11*g*, and 11*h*, the filter coefficients satisfying transfer functions obtained by equation 35, in the control processing section 12. Here, the two members, having 1 and 2 as j, of equation 33 are associated with M1 and M2 and therefore determine the acoustical effect on user L1. Similarly, the two members having 3 and 4 as j are associated with M3 and M4 and therefore determine the acoustical effect on user L2. The two members having 5 and 6 as j are associated with M5 and M6 and therefore determine the acoustical effect on user L3. The two members having 7 and 8 as j are associated with M7 and M8 and therefore determine the acoustical effect on user L4. Thus, by setting in each of the control digital filters a coefficient determined by adding values each obtained by multiplying the reference coefficient by a constant number as represented by equation 35, it becomes possible to individually control the sound volume at which each user listens. A ratio between the coefficients by which M1 and M2 are multiplied, a ratio between the coefficients by which M3 and M4 are multiplied, a ratio between the coefficients by which M5 and M6 are multiplied, and a ratio between the coefficients by which M7 and M8 are multiplied do not vary. In other words, a difference between the acoustic transfer functions for both ears does not vary. Therefore, the sound image localization effect is not deteriorated.

As described above, even in the case where there are four users, each user is allowed to set the sound volume individually while the sound image localization effect is being maintained. Further, as a matter of course, the present invention is not limited to the case for four users and is applicable to a case where there are more than four users.

Figure 3:
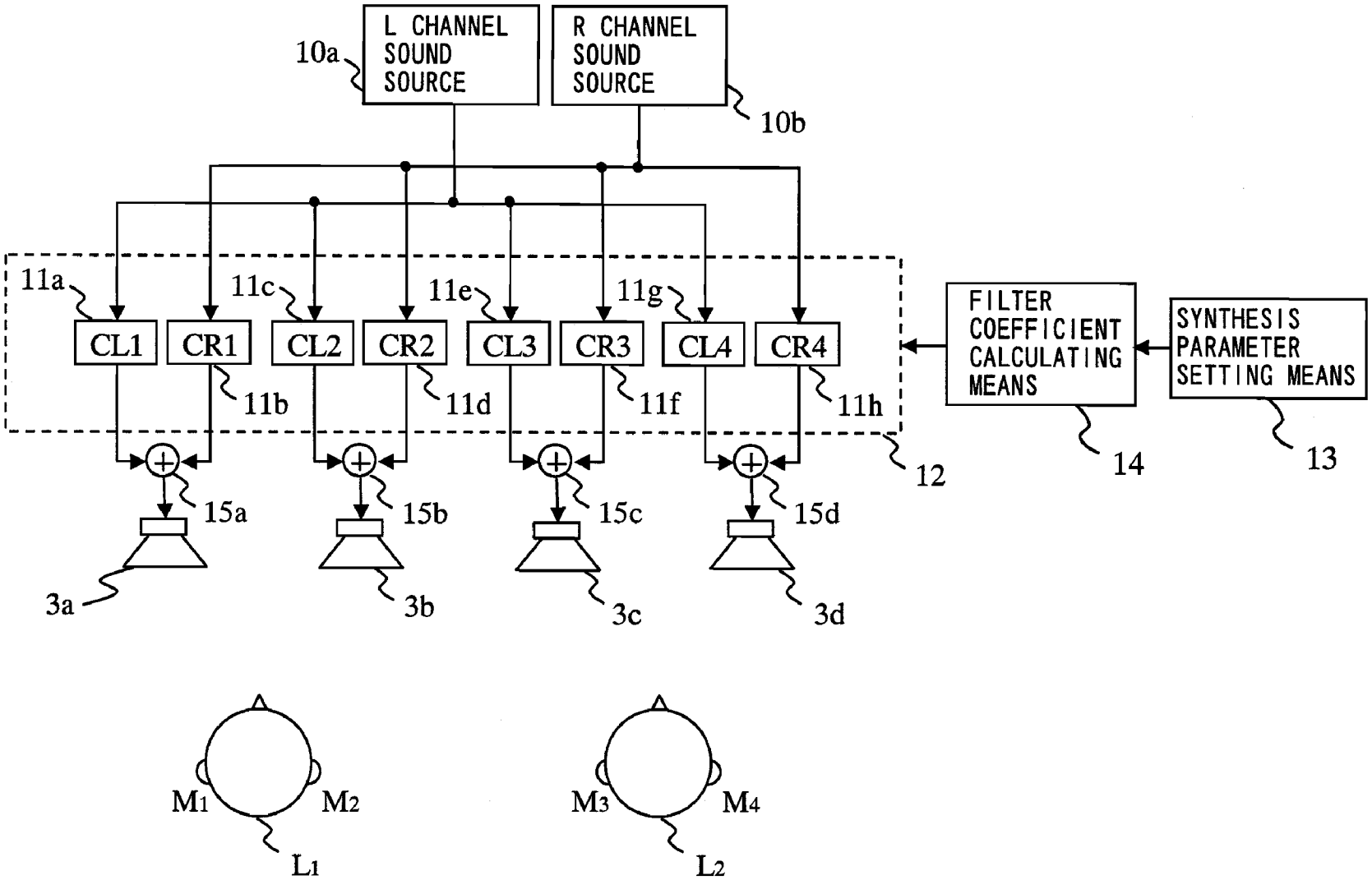
FIG. 3 is a schematic view of a configuration of the sound image localization control apparatus which realizes both the simultaneous sound image localization control and the individual sound volume adjustment in the case where a sound source is a stereo sound source.

Although the sound source is monophonic in the present embodiment, the present invention is also applicable to the multi-channel sound source. FIG. 3 is a schematic view of a configuration of the sound image localization control apparatus which realizes both the simultaneous sound image localization control and the individual sound volume adjustment, in the case where the sound source is a stereo sound source. Hereinafter, different components from those of the sound image localization control apparatus of FIG. 1 will be described. In FIG. 3, the sound image localization control apparatus comprises an L channel sound source 10*a*, an R channel sound source 10*b*, control digital filters 11*a*, 11*c*, 11*e*, and 11*g* to each of which an output from the L channel sound source 10*a* is inputted, control digital filters 11*b*, 11*d*, 11*f*, and 11*h* to each of which an output from the R channel sound source 10*b* is inputted, and adders 15*a*, 15*b*, 15*c*, and 15*d*. The adder 15*a* adds an output from the control digital filter 11*a* to an output from the control digital filter 11*b*. Similarly, the adder 15*b* adds an output from the control digital filter 11*c* to an output from the control digital filter 11*d*, the adder 15*c* adds an output from the control digital filter 11*e* to an output from the control digital filter 11*f*, and the adder 15*d* adds an output from the control digital filter 11*g* to an output from the control digital filter 11*h*.

The sound image localization control apparatus shown in FIG. 3 performs, by using the control digital filters 11*a*, 11*c*, 11*e* and 11*g*, sound image localization control on a signal from the L channel sound source 10*a* such that the signal is at a desired virtual sound source position. The sound image localization control apparatus performs, by using the control digital filters 11*b*, 11*d*, 11*f* and 11*h*, sound image localization control on a signal from the R channel sound source 10*b* such that the signal is at a desired virtual sound source position. The filter coefficient calculating means 14 stores filter coefficients separately for each channel. To be more specific, the filter coefficient calculating means 14 stores as reference coefficients eight filter coefficients satisfying transfer functions represented, as follows, by using the target transfer functions G1 and G2.

$$CL_{i1} = \sum_{j=1}^{2} H'_{ij} G_j,$$

$$CL_{i2} = \sum_{j=3}^{4} H'_{ij} G_{j-2},$$

$$CR_{i1} = \sum_{j=1}^{2} H'_{ij} G_j,$$

$$CR_{i2} = \sum_{j=3}^{4} H'_{ij} G_{j-2} \quad (i = 1 \text{ to } 4)$$

[equation 36]

In the meantime, information about a sound volume at which each user desires to listen is inputted to the synthesis parameter setting means 13. In the case where user L1 desires to listen at a sound volume which is α times higher than a sound volume obtained by sound reproduction using the reference coefficients and user L2 desires to listen at a sound volume which is β times higher than the sound volume obtained by sound reproduction using the reference coefficients, the synthesis parameter setting means 13 inputs information about the α times sound volume and the β times sound volume to the filter coefficient calculating means 14. The filter coefficient calculating means 14 calculates filter coefficients, by using the following equation, in accordance with information about the sound volumes, which is inputted from the synthesis parameter setting means 13.

$$CL_i=\alpha CL_{i1}+\beta CL_{i2},\ CR_i=\alpha CR_{i1}+\beta CR_{i2}\ (i=1 \text{ to } 4) \quad \text{[equation 37]}$$

The filter coefficient calculating means 14 sets, as coefficients for the control digital filters 11*a*, 11*b*, 11*c*, 11*d*, 11*e*, 11*f*, 11*g*, and 11*h*, the filter coefficients satisfying transfer functions obtained by equation 37, in the control processing section 12. Needless to say, when the sound volume of only a signal from the L channel sound source 10*a* should be adjusted, a filter coefficient determined by adding values each obtained by multiplying the filter coefficient included in CLi (i=1 to 4) by a constant number may be provided to the control processing section 12 as a coefficient for each of the control digital filters 11*a*, 11*c*, 11*e* and 11*g*.

(Second Embodiment)

Figure 4:
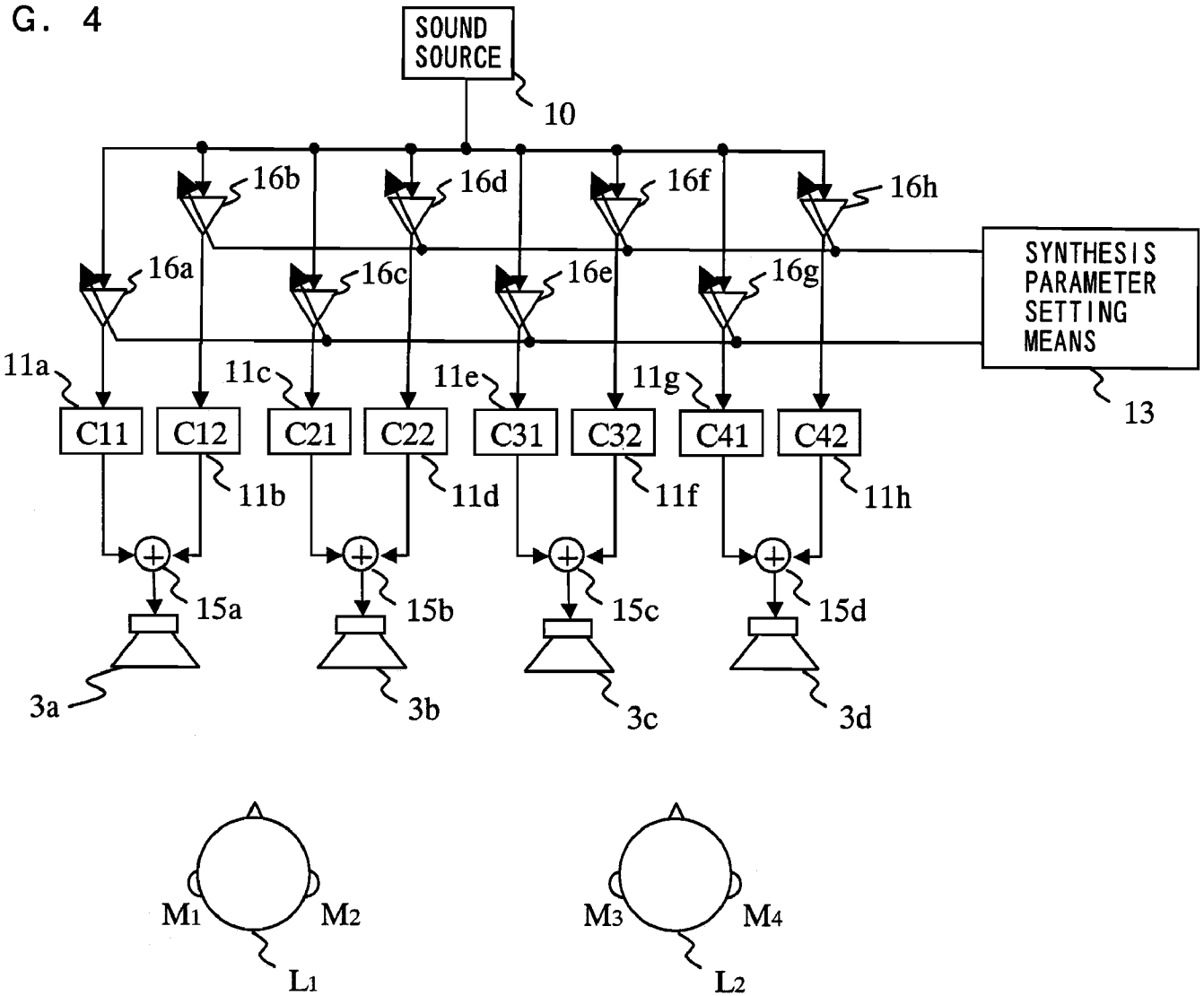
FIG. 4 is a schematic view showing a configuration of the sound image localization control apparatus according to a second embodiment.

FIG. 4 is a schematic view showing a configuration of a sound image localization control apparatus according to a second embodiment. The sound image localization control apparatus allows two users to share a common sound image localization effect and to individually adjust sound volumes. As shown in FIG. 4, the sound image localization control apparatus comprises the speakers 3*a*, 3*b*, 3*c*, and 3*d*, the sound source 10, control digital filters 11*a*, 11*b*, 11*c*, 11*d*, 11*e*, 11*f*, 11*g* and 11*h*, the synthesis parameter setting means 13, gain units 16*a*, 16*b*, 16*c*, 16*d*, 16*e*, 16*f*, 16*g*, and 16*h*, and the adders 15*a*, 15*b*, 15*c*, and 15*d*. In FIG. 4, identical components to those in the first embodiment will bear identical reference characters and detailed descriptions thereof will be omitted.

An output from the sound source 10 is inputted to the gain units 16*a*, 16*b*, 16*c*, 16*d*, 16*e*, 16*f*, 16*g*, and 16*h*, and variable adjustment of a gain is allowed. Outputs from the gain units 16*a*, 16*b*, 16*c*, 16*d*, 16*e*, 16*f*, 16*g*, and 16*h* are inputted to the control digital filters 11*a*, 11*b*, 11*c*, 11*d*, 11*e*, 11*f*, 11*g*, and 11*h*, respectively. The adder 15*a* adds an output from the control digital filter 11*a* to an output from the control digital filter 11*b*. Similarly, the adder 15*b* adds an output from the control digital filter 11*c* to an output from the control digital filter 11*d*. The adder 15*c* adds an output from the control digital filter 11*e* to an output from the control digital filter 11*f*. The adder 15*d* adds an output from the control digital filter 11*g* to an output from the control digital filter 11*h*. The synthesis parameter setting means 13 controls gains of the gain units 16*a*, 16*b*, 16*c*, 16*d*, 16*e*, 16*f*, 16*g*, and 16*h* and is an interface for each user to adjust the sound volume.

A filter coefficient satisfying transfer function C11 obtained by equation 28 is set in the control digital filter 11*a*. Similarly, a filter coefficient satisfying transfer function C12 obtained by equation 28 is set in the control digital filter 11*b*, a filter coefficient satisfying transfer function C21 is set in the control digital filter 11*c*, a filter coefficient satisfying transfer function C22 obtained by equation 28 is set in the control digital filter 11*d*, a filter coefficient satisfying transfer function C31 is set in the control digital filter 11*e*, a filter coefficient satisfying transfer function C32 is set in the control digital filter 11*f*, a filter coefficient satisfying transfer function C41 is set in the control digital filter 11*g*, and a filter coefficient satisfying transfer function C42 is set in the control digital filter 11*h*.

The synthesis parameter setting means 13 sets each of the gain units 16*a*, 16*b*, 16*c*, 16*d*, 16*e*, 16*f*, 16*g*, and 16*h* so as to have a gain, in accordance with a sound volume setting value which is set by each user. For example, when users L1 and L2 desire to listen at the α times sound volume and the β times sound volume, respectively, the synthesis parameter setting means 13 sets the gain units 16*a*, 16*c*, 16*e* and 16*g* so as to have a gain α. Meanwhile, the synthesis parameter setting means 13 sets the gain units 16*b*, 16*d*, 16*f* and 16*h* so as to have a gain β. This setting causes the speakers 3*a*, 3*b*, 3*c*, and 3*d* to output sounds obtained by applying acoustic transfer functions represented by the following equation to a sound from the sound source 10.

$$C_i=\alpha C_{i1}+\beta C_{i2}\ (i=1 \text{ to } 4) \quad \text{[equation 38]}$$

The outputs from the speakers 3*a*, 3*b*, 3*c*, and 3*d* in FIG. 4, which satisfy equation 38, are the same as the outputs from the speakers 3*a*, 3*b*, 3*c*, and 3*d* in the configuration shown in FIG. 1, which satisfy equation 29. Accordingly, as described in the first embodiment, users L1 and L2 are each able to listen to a reproduced sound at a sound volume which is optionally set by each user while the sound image localization control effect is being maintained.

As described above, by adjusting the gains in accordance with a sound volume set by each user, the sound image localization control apparatus according to the present embodiment allows each user to set the sound volume individually while the sound image localization control effect is being maintained, with a small amount of arithmetic processing.

Although the sound image localization control apparatus according to the present embodiment is described in the case of two users, the present invention is not limited thereto and the same effect is exerted on three or more users. In this case, components corresponding to the gain units 16*a*, 16*b*, 16*c*, and 16*d*, the control digital filters 11*a*, 11*b*, 11*c*, and 11*d*, the adders 15*a* and 15*b*, and the speakers 3*a* and 3*b*, all of which are shown in FIG. 4, may be increased based on the number of users to be increased.

The sound image localization control apparatus according to the present embodiment allows each user to control the sound volume individually while the sound image localization control effect is being maintained; however, when equalizers are provided, instead of (or in addition to) the gain units, each user is allowed to control sound quality individually while the sound image localization control effect is being maintained.

FIGS. 5 to 8 show examples where the sound image localization control apparatuses according to the first and second embodiments are applied.

Figure 5:
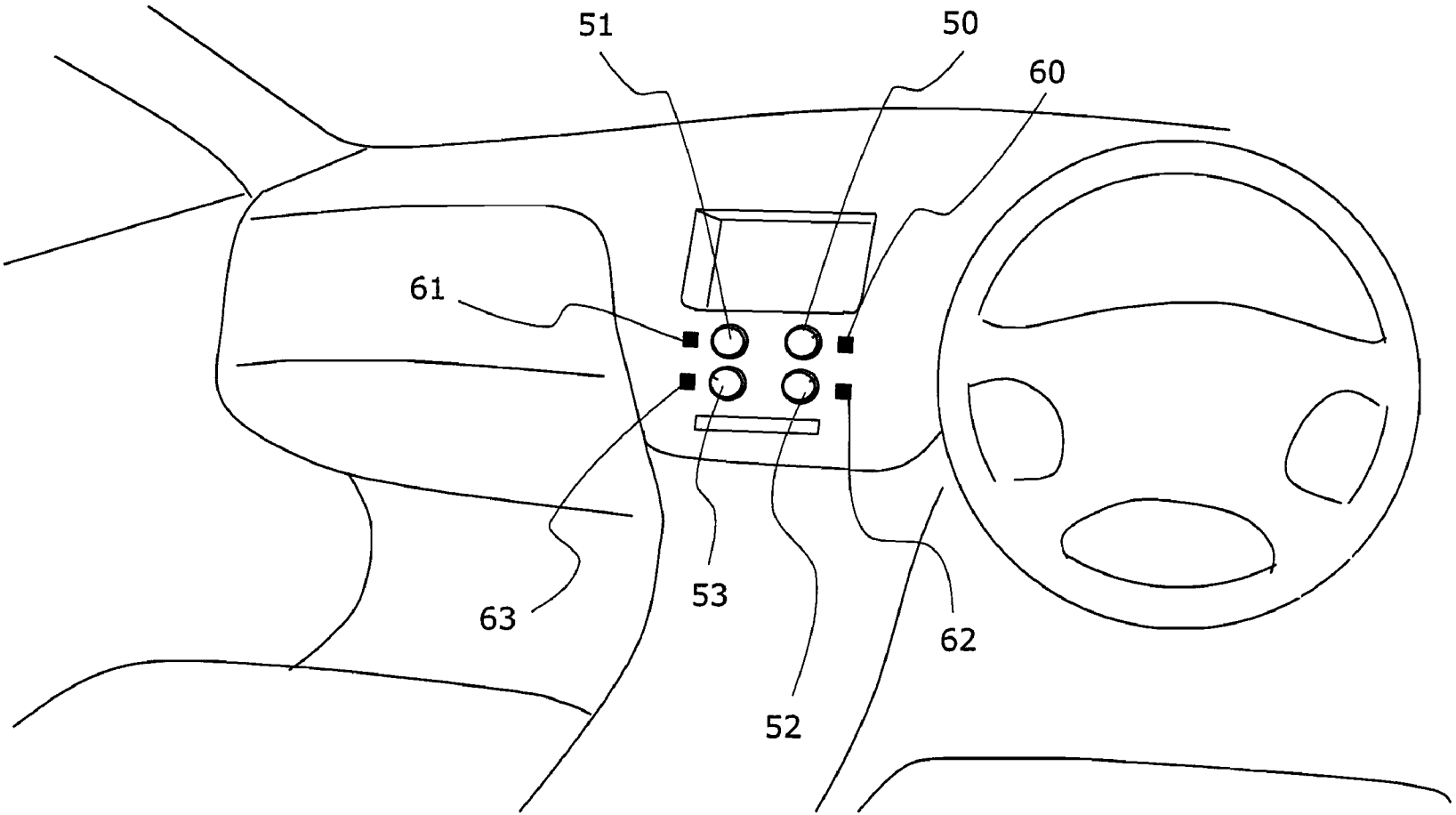
FIG. 5 is a diagram showing an example where the sound image localization control apparatus is applied to a vehicle.

FIG. 5 shows an example where the sound image localization control apparatus is installed in a vehicle, and an operating section thereof is provided on a dashboard. Sound volume adjusting dials 50 to 53 in FIG. 5, corresponding to the synthesis parameter setting means 13 in FIGS. 1 to 4, enable each user to adjust the sound volume individually. By pressing sound image localization control buttons 60 to 63, the sound image localization effect on each user is produced. A user in a driver's seat presses the sound image localization control button 60 so as to realize sound image localization of reproduced music. Further, the user in a driver's seat controls the sound volume adjusting dial 50 so as to change only for him/herself a sound volume to a set sound volume while the sound image localization is being maintained. On the other hand, a user in a front passenger's seat presses the sound image localization control button 61 and controls the sound volume adjusting dial 51 so as to change only for him/herself a sound volume to a set sound volume while the sound image localization is being maintained. In the same manner, users in the back seat control the sound volume adjusting dials 52 and 53, respectively, so as to change a sound volume at which each of the users listens.

Figure 6:
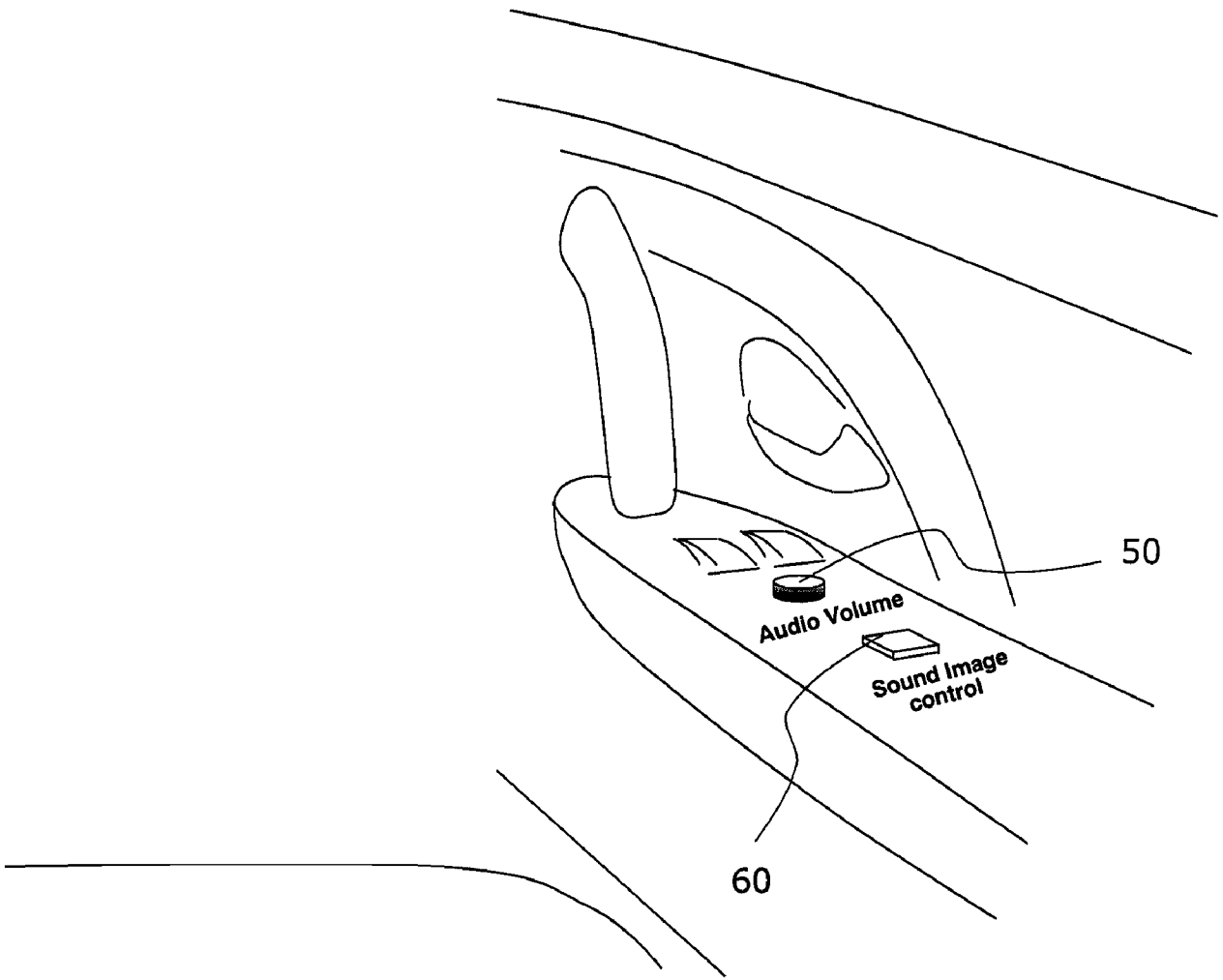
FIG. 6 is a diagram showing an example where the sound image localization control apparatus is applied to a vehicle.

As shown in FIG. 6, the operating section of the sound image localization control apparatus may be provided within the reach of each user, e.g., on an armrest of each of the seats. In this case, a user in each seat presses the sound image localization control button 60 provided on the armrest so as to realize sound image localization. Moreover, the user in each seat controls the sound volume adjusting dial 50 so as to change only for him/herself a sound volume to a set sound volume while the sound image localization is being maintained. Although a conventional sound image localization control apparatus does not allow each user to adjust the sound volume individually, the sound image localization control apparatus according to the present embodiment enables each user to adjust the sound volume individually while maintaining the sound image localization. Thus, as shown in FIG. 6, the number of operating sections for adjusting the sound volume may be the same as the number of users, and each operating section may be installed within the reach of a corresponding user.

Figure 7:
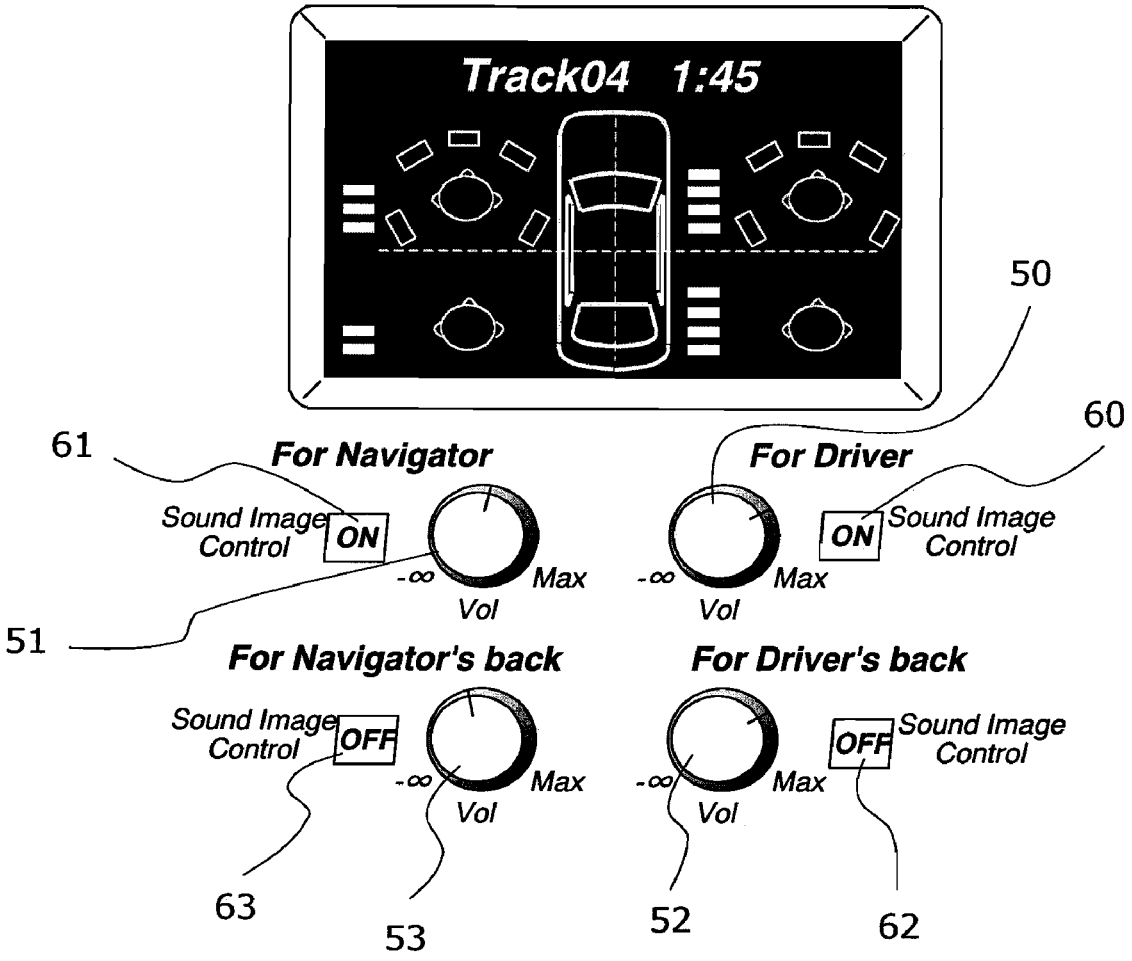
FIG. 7 is a diagram showing an example where the sound image localization control apparatus is applied to a vehicle.

Further, the operating section may be provided on a front panel section in a vehicle, as shown in FIG. 7, for example, and this allows a user to control collectively all the sound volumes for the seats. Installing all the operating sections for the users in one place together as shown in FIGS. 5 and 7 reduces wiring work and cost for installation.

Figure 8:
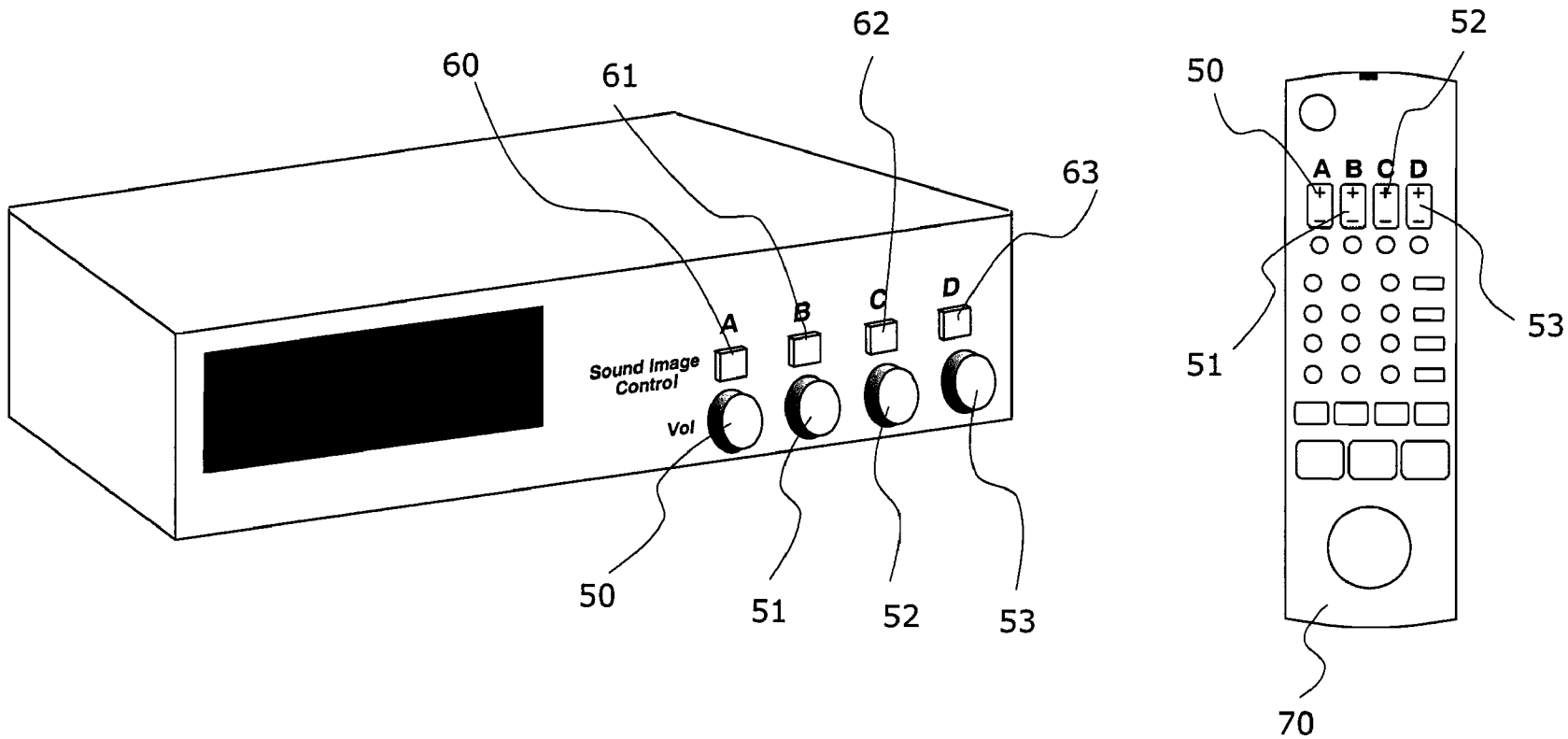
FIG. 8 is a diagram showing an example where the sound image localization control apparatus is applied to a home theatre.

FIG. 8 shows the sound image localization control apparatus applied to a home theatre, which may be used in a living room, for example. By pressing the sound image localization control buttons 60 to 63, the sound image effect is produced at predetermined positions in the living room. Further, by controlling the sound volume adjusting dials 50 to 53, the sound volume at each of the predetermined positions is changed individually while the sound image localization is being maintained. These operating sections may be provided in a remote controller 70.

A part or all of the components configuring the sound image localization control apparatuses according to the above-described embodiments can be realized as an integrated circuit in a form of a chip. Such an integrated circuit may be formed as an LSI circuit, a dedicated circuit, or a general purpose processor. Alternatively, an FPGA (Field Programmable Gate Array), which can be programmed after manufacturing LSI, or a re-configurable processor enabling connections and settings of circuit cells in the LSI to be reconfigured may be used. Further, in the case where an integration circuit technology replacing LSI becomes available due to improvement of a semiconductor technology or due to emergence of another technology derived therefrom, integration of the above-described components may be performed using such a technology. The aforementioned reference coefficients may be stored in a memory device, which is externally connected to the integrated circuit. In this case, the integrated circuit reads the reference coefficients stored in the memory device and performs signal processing.

Figure 13:
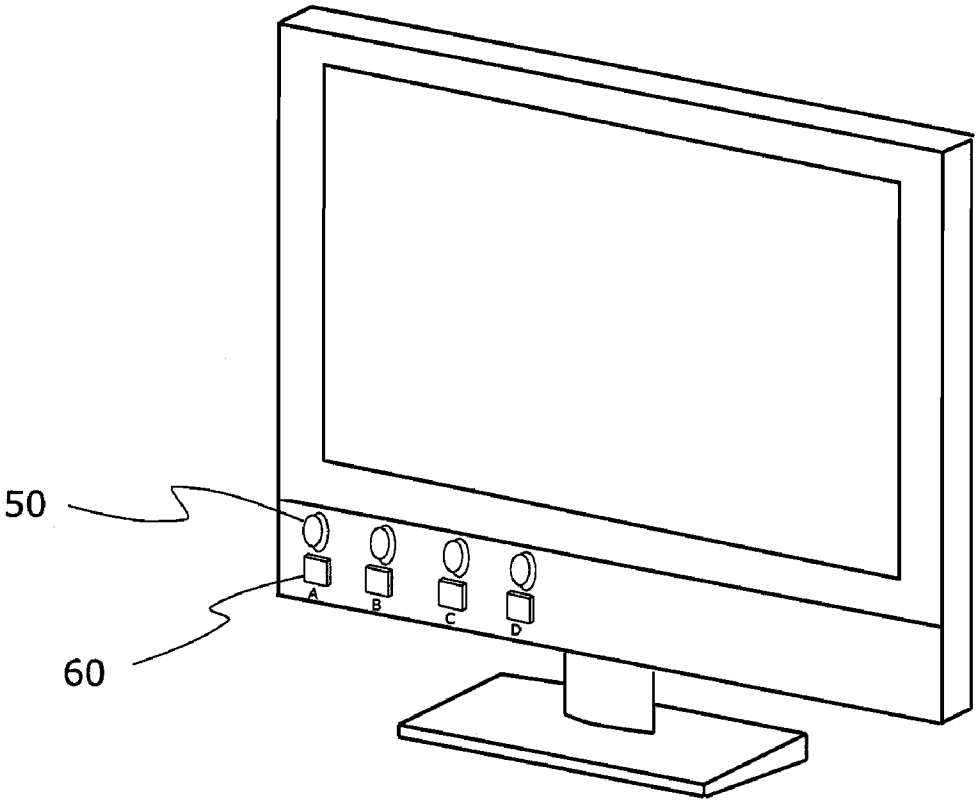
FIG. 13 is a diagram showing an example where the sound image localization control apparatus is provided for a television receiver.
Figure 13:
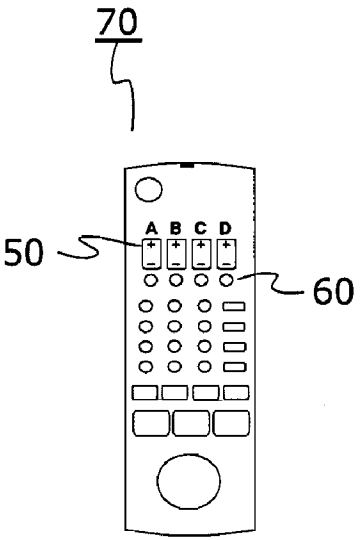

The sound image localization control apparatuses according to the embodiments described above may be applied not only to a car audio device and a home theater but also to various apparatuses for adjusting the sound volume and sound quality. For example, as shown in FIG. 13, the sound image localization control apparatus may be provided in a television receiver. The sound image localization control button 60 for producing the sound image localization effect for each user individually and the sound volume adjusting dial 50 for adjusting the sound volume for each user individually may be provided in the television receiver, or may be provided in the remote controller 70. In the case of a game apparatus, the sound image localization control button and the sound volume adjusting dial may be provided in a controller. Users are each allowed to change the sound volume and the frequency characteristic individually while watching video, and thus a television receiver and a game apparatus with improved convenience are provided.

Industrial Applicability

The present invention is suitable for a reproducing apparatus or the like which may be used in a living room or in a vehicle etc., where an ideal sense of localization and an improved sound field are desired.

The invention claimed is:

1. A sound image localization control apparatus that provides sound image localization for at least two listeners, the sound image localization control apparatus comprising:

an input section through which an acoustic signal is externally inputted;

a plurality of controlling means, each controlling means of the plurality of controlling means including a digital filter for processing the acoustic signal inputted through the input section, such that each respective digital filter of the plurality of controlling means processes the acoustic signal according to a respective filter coefficient;

processing characteristic setting means (i) storing, in a storage area and for each respective digital filter of the plurality of controlling means, a reference coefficient corresponding each respective listener of the at least two listeners, (ii) calculating, for each respective digital filter, a respective multiplication coefficient for each respective listener of the at least two listeners by multiplexing (a) a value based on at least one of a sound volume control signal and a sound quality control signal corresponding to the respective listener and (b) the stored reference coefficient corresponding to the respective listener and the respective digital filter, and (iii) determining the respective filter coefficient for each respective digital filter by summing, for each respective digital filter, the multiplication coefficient calculated for each respective listener; and a plurality of sound reproducing means, each respective sound reproducing means of the plurality of sound reproducing means corresponding to a respective controlling means of the plurality of controlling means, and each respective sound reproducing means being for receiving an output from the corresponding controlling means of the plurality of controlling means, wherein a difference between acoustic transfer functions from the input section to positions of both ears of each respective listener is constant regardless of the at least one of the sound volume control signal and the sound quality control signal.

2. The sound image localization control apparatus according to claim 1, wherein the processing characteristic setting means stores, in the storage area, at least two reference coefficients corresponding to at least two predetermined positions, respectively, and determines the filter coefficient for each respective digital filter using the reference coefficients corresponding to the at least two predetermined positions, respectively.

3. The sound image localization control apparatus according to claim 1, wherein the processing characteristic setting means sets, in each controlling means of the plurality of controlling means, as the respective filter coefficient, a value resulting from linearly combining at least two reference coefficients corresponding to at least two predetermined positions, respectively, based on values depending on a desired characteristic corresponding to each of the at least two predetermined positions.

4. The sound image localization control apparatus according to claim 1, wherein each controlling means of the plurality of controlling means includes a plurality of digital filters; and wherein the processing characteristic setting means stores, in the storage area and for each respective controlling means of the plurality of controlling means, a first reference coefficient for a first predetermined position for each of the plurality of digital filters and a second reference coefficient for a second predetermined position for each of the plurality of digital filters and sets, for each respective controlling means of the plurality of controlling means, the respective filter coefficient for each digital filter of the plurality of digital filters, the respective filter coefficient being obtained by adding (i) a value obtained by multiplying, by the first reference coefficient, a value based on the at least one of the sound volume control signal and the sound quality control signal for the first predetermined position and (ii) a value obtained by multiplying, by the second reference coefficient, a value based on the at least one of the sound volume control signal and the sound quality control signal for the second predetermined position.

5. The sound image localization control apparatus according to claim 1, wherein the plurality of controlling means includes:

at least two gain means, each gain means of the at least two gain means receiving an acoustic signal and the respective filter coefficient determined by the processing characteristic setting means and performing gain control on the acoustic signal;

at least two characteristic controlling means, each characteristic controlling means of the at least two characteristic controlling means receiving an output from a gain means of the at least two gain means and performing signal processing; and adding means adding outputs from the at least two characteristic controlling means, and wherein the processing characteristic setting means sets the gain means such that acoustic transfer functions for at least two predetermined positions each represents a desired characteristic.

6. The sound image localization control apparatus according to claim 5, wherein each of the at least two characteristic controlling means includes a first digital filter having, as the filter coefficient, a first reference coefficient corresponding to a first predetermined position, and a second digital filter having, as the filter coefficient, a second reference coefficient corresponding to a second predetermined position, and wherein the processing characteristic setting means sets a value based on the sound volume control signal for the first predetermined position, in one of the at least two gain means corresponding to the first digital filter, and sets a value based on the sound volume control signal for the second predetermined position, in another of the at least two gain means corresponding to the second digital filter.

7. The sound image localization control apparatus according to claim 1, wherein the plurality of controlling means includes:

at least two frequency means, each frequency means of the at least two frequency means receiving an acoustic signal and the respective filter coefficient determined by the processing characteristic setting means and performing frequency control on the acoustic signal;

at least two characteristic controlling means, each characteristic controlling means of the at least two characteristic controlling means receiving an output from a frequency means of the at least two frequency means and performing signal processing; and adding means adding outputs from the at least two characteristic controlling means, and wherein the processing characteristic setting means sets the frequency means such that acoustic transfer functions for at least two predetermined positions each represents a desired characteristic.

8. The sound image localization control apparatus according to claim 7, wherein the at least two characteristic controlling means includes a first digital filter having, as the filter coefficient, a first reference coefficient corresponding to a first predetermined position, and a second digital filter having, as the filter coefficient, a second reference coefficient corresponding to a second predetermined position, and wherein the processing characteristic setting means sets a value based on the sound quality control signal for the first predetermined position, in one of the at least two frequency means corresponding to the first digital filter, and sets a value based on the sound quality control signal for the second predetermined position, in another of the at least two frequency means corresponding to the second digital filter.

9. The sound image localization control apparatus according to claim 2, wherein the processing characteristic setting means further includes operating sections, such that a number of operating sections included in the processing characteristic setting means corresponds to a number of users, so as to allow each of the users to set a processing characteristic.

10. The sound image localization control apparatus according to claim 9, wherein the operating sections are placed in proximity to each other.

11. The sound image localization control apparatus according to claim 9, wherein each of the operating sections are placed at a position, so as to allow each of the users to operate a corresponding operating section of the operating sections.

* * * * *